US006593707B1

(12) United States Patent
Shih

(10) Patent No.: US 6,593,707 B1
(45) Date of Patent: Jul. 15, 2003

(54) CROSS CONNECTION STRUCTURE FOR DUAL HIGH-PRESSURE DISCHARGE LAMP BANKS AND TRANSFORMERS THEREOF

(75) Inventor: Wen-Chu Shih, Taipei (TW)

(73) Assignee: Hwa Young Co., Ltd., Taipei (TW)

( * ) Notice: Subject to any disclaimer, the term of this patent is extended or adjusted under 35 U.S.C. 154(b) by 0 days.

(21) Appl. No.: 10/146,996

(22) Filed: May 15, 2002

(51) Int. Cl.[7] ..... H05B 41/16

(52) U.S. Cl. ..... 315/277; 315/246; 315/144; 315/271; 315/312; 315/324; 315/209 R

(58) Field of Search ..... 315/277, 276, 315/143, 144, 142, 188, 185 R, 191, 192, 209 R, 220, 246, 250, 255, 312, 324, 325, 271

(56) References Cited

U.S. PATENT DOCUMENTS 4,663,566 A * 5/1987 Nagano ..... 315/97
6,201,352 B1 * 3/2001 Ge et al. ..... 315/169.1
6,515,427 B2 * 2/2003 Oura et al. ..... 315/141

* cited by examiner

*Primary Examiner*—Don Wong
*Assistant Examiner*—Tuyet T. Vo
(74) *Attorney, Agent, or Firm*—Pro-Techtor International Services

(57) ABSTRACT

Two high-pressure discharge lampbanks and transformers thereof are connected via a cross connection manner. The two lamp banks include the same number of high-pressure discharge lamps, and the transformers are in a number corresponding to that of lamps in each lamp bank. All the transformers have two outputs, namely, first and second outputs, at a secondary side thereof. First outputs of all the transformers are separately connected to the lamps in a first one of the two high-pressure discharge lamp banks while second outputs of all the transformers are separately connected to the lamps in a second one of the two high-pressure discharge lamp banks. Thereby, lamps in the same lamp bank are maintained at a voltage having the same phase and have a small potential difference among them to avoid interference noises.

1 Claim, 2 Drawing Sheets

CROSS CONNECTION STRUCTURE FOR DUAL HIGH-PRESSURE DISCHARGE LAMP BANKS AND TRANSFORMERS THEREOF

BACKGROUND OF THE INVENTION

The present invention relates to a cross connection structure for dual high-pressure discharge lamp banks and transformers thereof. With the cross connection structure, high-pressure discharge lamps in the same lamp bank could be maintained at a voltage having the same phase with a small potential difference among them. The problem of mutually repulsion among the lamps in the same lamp bank is eliminated to ensure safe use of the lamps.

FIG. 1 shows a conventional manner for connecting dual high-pressure discharge lamp banks to transformers thereof. A first high-pressure discharge lamp bank LP1 includes a plurality of high-pressure discharge lamps LP11, LP12; and a second high-pressure discharge lamp bank LP2 also includes a plurality of high-pressure discharge lamps LP21, LP22. In the illustrated drawing, only two lamps are shown for each lamp bank. The high-pressure discharge lamps in the same lamp bank correspond to one transformer. A first transformer T1 corresponded to the first lamp bank LP1 is connected at two outputs at a secondary side thereof to two lamps of the first high-pressure discharge lamp bank. That is, the first transformer T1 has a first output T11 connected to a high-pressure discharge lamp LP11, and a second output T12 connected to another high-pressure discharge lamp LP12. The lamps in the second high-pressure discharge lamp bank are also connected to one transformer in the same manner. That is, a second transformer T2 is connected at two outputs at a secondary side thereof to two lamps of the second high-pressure discharge lamp bank LP2. More specifically, a first output T21 of the second transformer T2 is connected to a high-pressure discharge lamp LP21, and a second output T22 of the second transformer T2 is connected to another high-pressure discharge lamp LP22 in the second lamp bank LP2. On the other hand, primary sides of the transformers T1 and T2 are connected to drive circuits 1 and 2, respectively. And, the drive circuits 1, 2 are connected via a signal line 3 to work synchronously.

The above-described connection between dual high-pressure discharge lamp banks and transformers thereof has the following drawback that two lamps in the same lamp bank separately receive from two outputs at the secondary side of the same transformer positive and negative voltages having the same magnitude but reverse polarities. For example, the lamp LP11 in the first high-pressure discharge lamp bank LP1 receives at a certain time point a positive voltage from the first output T11 of the first transformer T1, while another adjacent lamp LP12 in the same lamp bank LP1 receives at the same time from the second output T12 of the first transformer T1 a negative voltage having a phase reverse to that of the positive voltage received by the lamp LP11. The high-pressure discharge lamps in the same lamp bank are very closely arranged, and there is an extremely large potential difference between two adjacent lamps. For example, in the case each of the high-pressure discharge lamps has a voltage of 500V, there will be an instantaneous maximum potential difference as high as 1000V between the positive and the negative voltage of two adjacent lamps. The closely arranged lamps in the same lamp bank and the extremely high potential difference between two adjacent lamps result in noises and mutual interference of these lamps with one another. The same situation also occurs in the second high-pressure discharge lamp bank LP2.

SUMMARY OF THE INVENTION

A primary object of the present invention is to provide a cross connection structure for dual high-pressure discharge lamp banks and transformers thereof to eliminate the drawback existing in the conventional connection manner, so that all high-pressure discharge lamps in the same lamp bank are maintained at a voltage having the same phase without the problem of mutual repulsion between two adjacent lamps.

To achieve the above and other objects, each high-pressure discharge lamp bank includes a plurality of high-pressure discharge lamps, and each transformer includes two outputs at the secondary side. First outputs of all transformers are separately connected to the high-pressure discharge lamps in a first lamp bank, while second outputs of all transformers are separately connected to the high-pressure discharge lamps in a second lamp bank. In this manner, all the high-pressure discharge lamps in the same lamp bank are maintained at a voltage having the same phase with a small potential difference among them. The lamps in the same lamp bank would not mutually repulse and can therefore be safely used. The problem of mutual interference due to noises caused by voltages of different phases and big potential difference can also be avoided.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
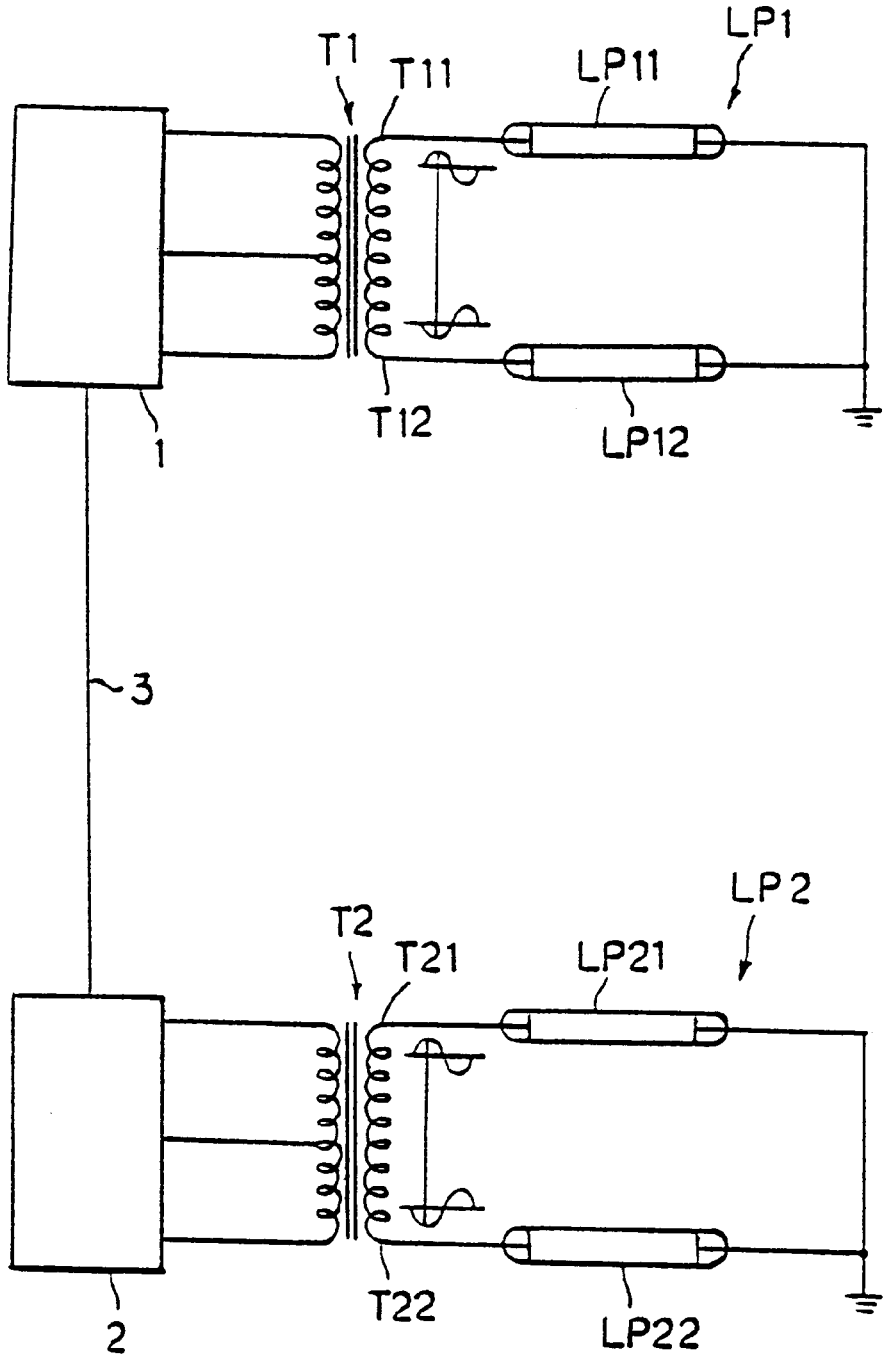
FIG. 1 (Prior Art)
FIG. 1 shows a conventional manner of connecting dual high-pressure discharge lamp banks to transformers thereof.
Figure 2:
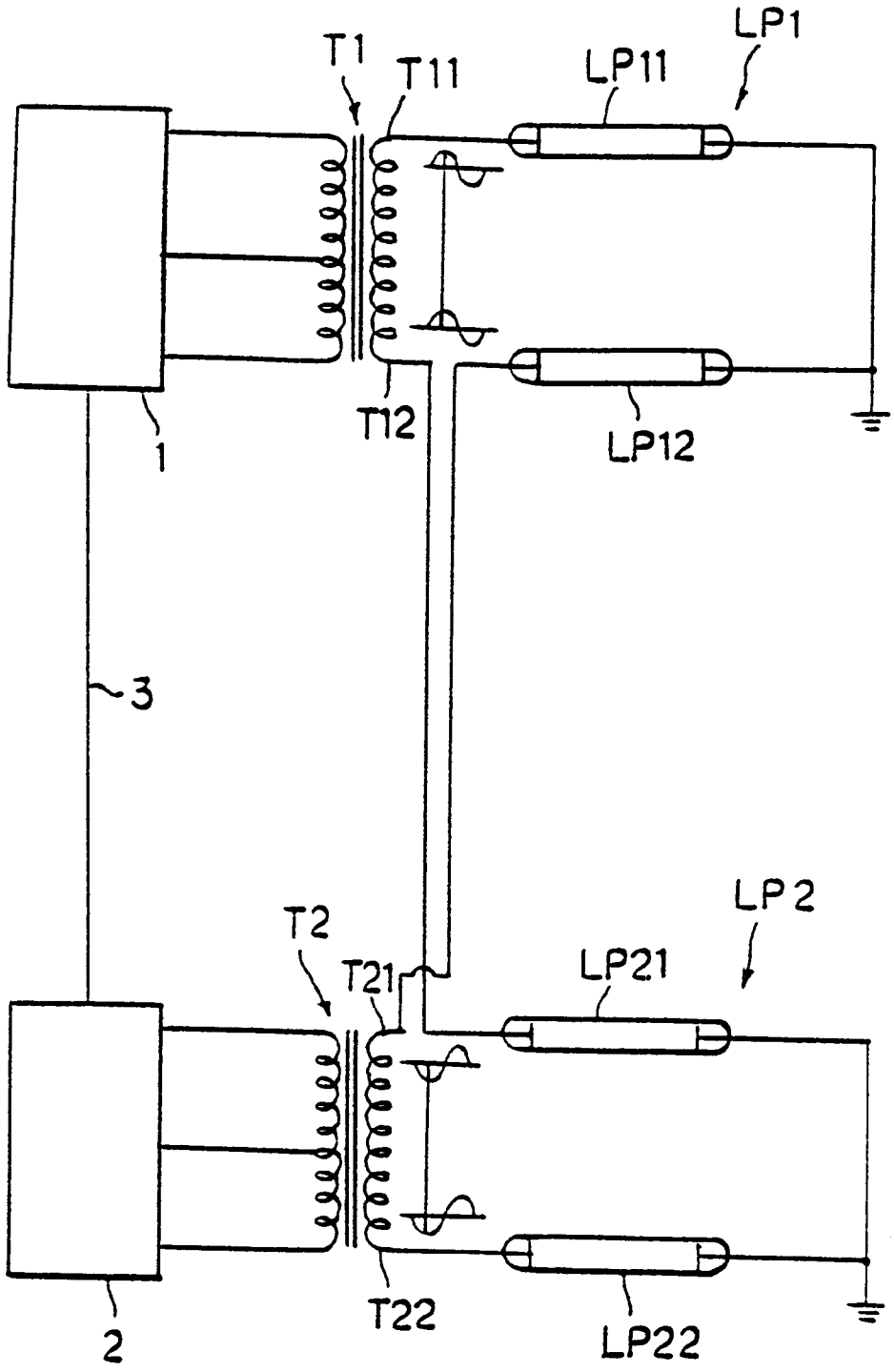
FIG. 2 shows a cross connection structure for dual high-pressure discharge lamp banks and transformers thereof according to the present invention.

Please refer to FIG. 2 that shows a cross connection structure for dual high-pressure discharge lamp banks and transformers thereof according to the present invention. As shown in FIG. 2, the dual high-pressure discharge lamp banks include a first lamp bank LP1 having a plurality of high-pressure discharge lamps LP21, LP12, and a second lamp bank LP2 having a plurality of high-pressure discharge lamps LP21, LP22. The number of the lamps in the second high-pressure discharge lamp bank LP2 is the same as that in the first high-pressure discharge lamp bank LP1. For simplicity, only two lamps are illustrated in each lamp bank. Moreover, in the present invention, the transformers are in a number the same as that of the lamps in each high-pressure discharge lamp bank. In FIG. 2, two transformers T1 and T2 are illustrated corresponding to two lamps included in each lamp bank.

Primary sides of the transformers T1 and T2 are connected to drive circuits 1 and 2, respectively, and the drive circuits 1, 2 are connected to each other via a signal line 3 to work synchronously. Secondary sides of the transformers T1, T2 respectively include two outputs. First outputs at the secondary sides of all transformers T1, T2 are separately connected to the high-pressure discharge lamps in the first lamp bank LP1, while second outputs at the secondary sides of all transformers T1, T2 are separately connected to the high-pressure discharge lamps in the second lamp bank LP2.

That is, first outputs T11 and T21 of first and second transformers T1 and T2, respectively, are separately connected to two lamps LP11, LP12 in the first lamp bank LP1, while second outputs T12 and T22 of first and second transformers T1 and T2, respectively, are separately connected to two lamps LP21, LP22 in the second lamp bank LP2.

With the above-described cross connection between dual high-pressure discharge lamp banks and transformers thereof, high-pressure discharge lamps in the same lamp bank are maintained at a voltage having the same phase. For example, two lamps LP11 and LP12 in the first high-pressure discharge lamp bank LP1 could obtain positive or negative voltage having the same phase, while another two lamps LP21 and LP22 in the second high-pressure discharge lamp bank LP2 could obtain negative or positive voltage having the same phase. Moreover, there is only a very small potential difference existing between any two adjacent lamps in each lamp bank. The lamps would not mutually repulse to ensure safe use thereof. The problem of interference noises caused by different voltage phases and big potential difference between lamps as otherwise existing in the conventional connection manner is also eliminated.

What is claimed is:

1. A cross connection structure for dual high-pressure discharge lamp banks and transformers thereof, comprising:

two high-pressure discharge lamp banks including the same number of high-pressure discharge lamps; and a plurality of transformers in a number corresponding to that of said high-pressure discharge lamps in each said high-pressure discharge lamp bank; primary sides of said transformers being respectively connected to drive circuits that are connected to one another via signal lines to work synchronously, and secondary sides of said transformers respectively having two outputs, namely, first and second outputs; said first outputs of all said transformers being separately connected to said lamps in a first one of said two high-pressure discharge lamp banks, and said second outputs of all said transformers being separately connected to said lamps in a second one of said two high-pressure discharge lamp banks.

* * * * *

UNITED STATES PATENT AND TRADEMARK OFFICE

CERTIFICATE OF CORRECTION

PATENT NO. : 6,593,707 B1
DATED : July 15, 2003
INVENTOR(S) : Wen-Chu Shih

It is certified that error appears in the above-identified patent and that said Letters Patent is hereby corrected as shown below:

Title page,
Item [73], Assignee, delete "Hwa Young Co., Ltd." and insert
-- Hwa Youn Co., Ltd. --

Signed and Sealed this

Fourth Day of November, 2003

JAMES E. ROGAN
*Director of the United States Patent and Trademark Office*